US007694459B2

(12) United States Patent
Brunnmayr

(10) Patent No.: US 7,694,459 B2
(45) Date of Patent: Apr. 13, 2010

(54) SPRING LOADED ACTUATING ARM FOR MOVING A FLAP OF A PIECE OF FURNITURE

(75) Inventor: Harald Brunnmayr, Hörbranz (AT)

(73) Assignee: Julius Blum GmbH, Industriestrasse (AT)

( * ) Notice: Subject to any disclaimer, the term of this patent is extended or adjusted under 35 U.S.C. 154(b) by 0 days.

(21) Appl. No.: 11/798,416

(22) Filed: May 14, 2007

(65) Prior Publication Data

US 2007/0257538 A1 Nov. 8, 2007

(30) Foreign Application Priority Data

Nov. 18, 2004 (AT) ..... 1935/2004
Apr. 28, 2005 (AT) ..... 731/2005

(51) Int. Cl.
*E05F 9/00* (2006.01)

(52) U.S. Cl. ..... 49/356; 49/339

(58) Field of Classification Search ..... 49/324, 49/356, 339; 16/82; 292/262, 275, 278, 292/DIG. 15; 403/327, 329, 330
See application file for complete search history.

(56) References Cited

U.S. PATENT DOCUMENTS 3,480,247 A * 11/1969 Waner ..... 292/275
4,087,883 A * 5/1978 Amdal ..... 16/82
4,750,238 A * 6/1988 Rock et al. ..... 16/241
4,760,623 A * 8/1988 Toyama ..... 16/238
4,862,555 A 9/1989 Grass
5,039,147 A * 8/1991 Moon et al. ..... 292/338
5,108,216 A * 4/1992 Geyer et al. ..... 403/330
5,217,267 A * 6/1993 Yagi ..... 292/338
5,460,346 A * 10/1995 Hirsch ..... 248/229.13
5,882,099 A * 3/1999 Salice ..... 312/328
6,332,660 B1 * 12/2001 Salice ..... 312/328
6,877,830 B2 4/2005 Salice
7,168,477 B2 * 1/2007 Salice ..... 160/213
7,240,974 B2 * 7/2007 Hirtsiefer ..... 312/109
2002/0108311 A1 * 8/2002 Salice ..... 49/371

FOREIGN PATENT DOCUMENTS

| | | |
|---|---|---|
| DE | 24 54 897 | 8/1976 |
| DE | 27 21 104 | 11/1978 |
| DE | 29 34 506 | 3/1981 |
| DE | 37 18 730 | 12/1988 |
| DE | 200 08 292 | 8/2000 |
| DE | 201 00 662 | 5/2001 |
| EP | 0 535 866 | 4/1993 |
| WO | 01/08854 | 2/2001 |

* cited by examiner

*Primary Examiner*—Gregory J Strimbu
(74) *Attorney, Agent, or Firm*—Wenderoth, Lind & Ponack, L.L.P.

(57) ABSTRACT

An actuator for moving a flap of a piece of furniture includes a spring loaded actuating arm and a mechanical locking connection provided at each end of the actuating arm. The mechanical locking connections connect the arm in a detachable manner to a body of the piece of furniture and to the flap of the piece of furniture. By this arrangement the actuating arm can be hinged in a simple manner to the base body and removed again if necessary.

12 Claims, 11 Drawing Sheets

31
30'
30
28
28'

2
31
28
28'
30'
30
3

3
29
28
8
30
31
24
26
25
23
27
2
1

SPRING LOADED ACTUATING ARM FOR MOVING A FLAP OF A PIECE OF FURNITURE

This application is a continuation of International Application No. PCT/AT2005/000427, filed Oct. 28, 2005.

FIELD OF INVENTION

The present invention relates to an actuator for moving a flap of a piece of furniture, comprising a base body mounted on the furniture body and on the flap and an actuating arm, which is provided for moving the flap.

BACKGROUND OF THE INVENTION

Actuators of this kind are usually fixed onto a side wall of a furniture body and are used to move a flap hinged onto the actuating arm from an open to a closed position or in opposite direction. The actuating arm is usually loaded by a spring device, but there is the risk of injury if the flap of the piece of furniture is not connected to the actuating arm, as the latter which is relatively light-weight can shoot out like a bullet. The base body with the pivotably mounted actuating arm makes it more difficult to handle the actuator and for logistical reasons it also requires a large amount of packaging.

From DE 24 54 897 A1 a fitting is known for a flap of a piece of furniture that can pivot upwardly, in which a lever guiding member can be connected in a detachable manner to a hinge support mounted on the flap. However, the assembly and disassembly of the lever guiding member on the flap has proved to be elaborate in this case.

SUMMARY OF THE INVENTION

It is therefore an object of the present invention to propose an actuator of the aforementioned type avoiding the above disadvantages.

This is achieved according to the invention in that the actuating arm at both ends comprises fastening devices with a mechanical locking connection, wherein a first fastening device is provided for connecting the actuating arm in a detachable manner to a base body mounted on the furniture body and a second fastening device is provided for connecting the actuating arm in a detachable manner to a base body secured to the flap.

By means of the arrangement of such a fastening device the actuating arm can be hinged in a simple manner onto or into the base body (core) and removed again if necessary. For logistical reasons the amount of packaging is reduced, as each part—i.e. base body and actuating arm—can be packed separately. The handling of the actuator is thus considerably improved as there is no protruding part to make the handling of the actuator more difficult. The risk of the actuating arm shooting out if the flap of the piece of furniture is not connected by hinge can be largely avoided, as the actuating arm can simply be removed at critical moments when no flap is mounted on the actuating arm. A particular advantage lies in the fact that various different actuating arms corresponding to the size and the weight of the flap of the piece of furniture can be hinged onto the same base body with the same design of fastening device, which provides a high degree of variability in different assembly situations.

Preferably, the design can be such that the mechanical locking connection comprises two interlockable locking elements, whereby one locking element can be inserted into the other locking element and then locked together with the latter by a pivoting movement. In this way the actuating arm can be clipped onto the base body and/or the flap of the piece of furniture in a simple manner.

According to an advantageous embodiment of the invention one locking element of the mechanical locking connection comprises a preferably spring-loaded retainer which can be locked together with the other locking element. Alternatively or additionally, it may be advantageous if the mechanical locking connection comprises a spring-loaded retaining nose, which is provided for securing the actuating arm and which can be disengaged by pressure against its spring force.

In order to adjust the length of the actuating arm to various different flaps on pieces of furniture and/or with a different assembly position of the base body on a side wall of the piece of furniture, it can be advantageous if the actuating arm comprises at least two parts that can be moved relative to one another or can be secured to one another. These kinds of longitudinally-adjustable actuating arm levers are known from the prior art and can have various different designs. In order to fix the actuating arm at the adjusted length it is preferable if the relative position of the parts is secured by a clamping connection.

BRIEF DESCRIPTION OF THE FIGURES

Further details and advantages of the present invention are explained in more detail in the following by way of the description of the Figures with reference to the drawings, wherein.

DETAILED DESCRIPTION OF THE INVENTION

Figure 1:
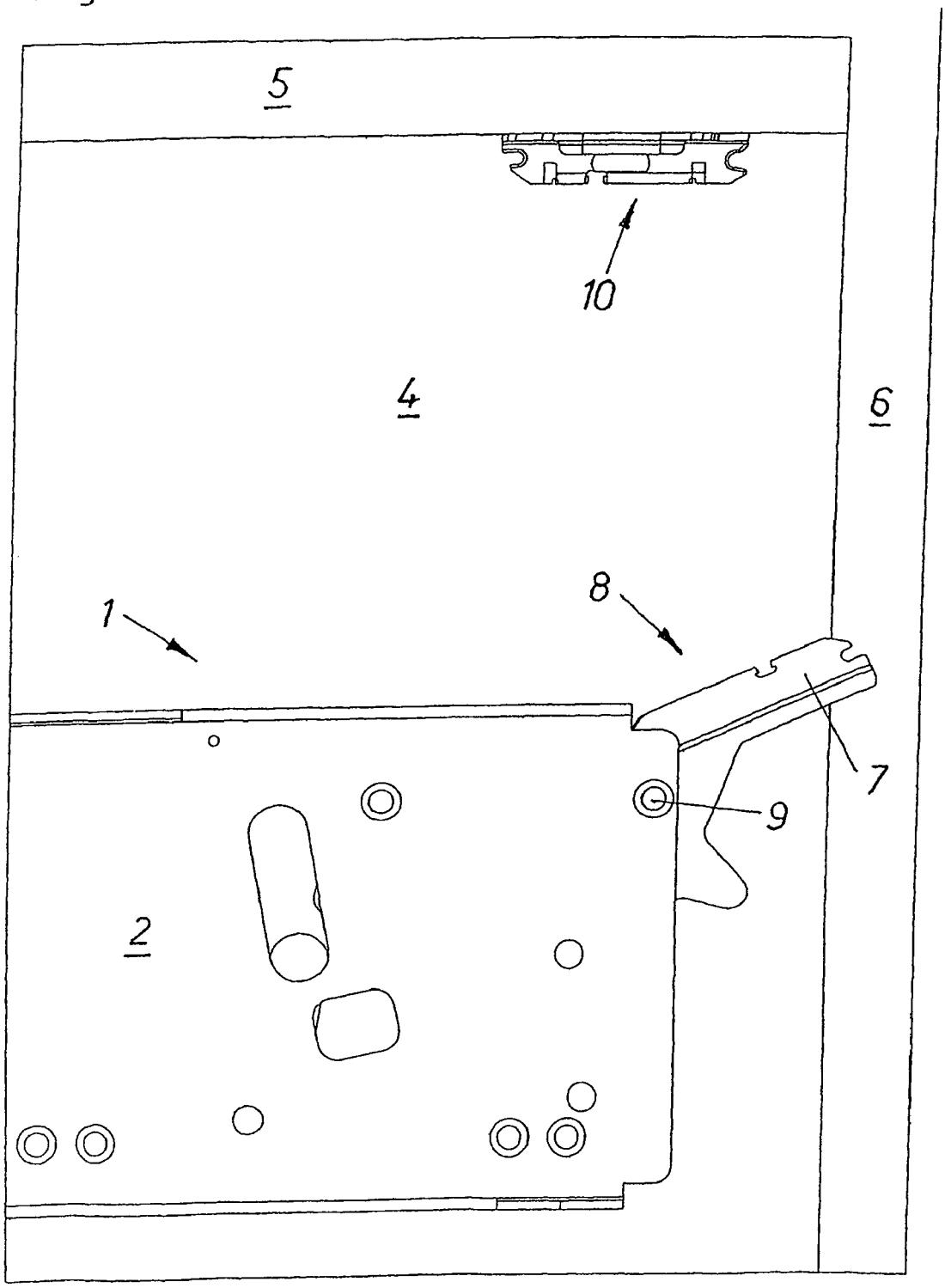
FIG. 1 shows a side view of a piece of furniture with a mounted base body.

FIG. 1 shows a side view of a furniture body 4, on the side wall of which a base body 2 of an actuator 1 according to the invention is secured. In the embodiment shown the base body 2 comprises a locking element 7, which is mounted on its centre of rotation 9 and is part of the fastening device 8. An actuating arm 3, which is not shown for reasons of clarity, can be locked mechanically to said locking element 7. Said actuating arm 3 can thus be hinged at one end to the locking element 7 and to a flap 6 shown by way of example and moves the latter from a closed position to an open position. A base plate 10 is screwed onto the underside of the cabinet shelf 5, on the base plate of which—as already known in the prior art—a hinge can be clipped in a simple manner thereon, so that the flap 6 can be pivoted about a horizontal axis in the region of cabinet shelf 5.

Figure 2A:
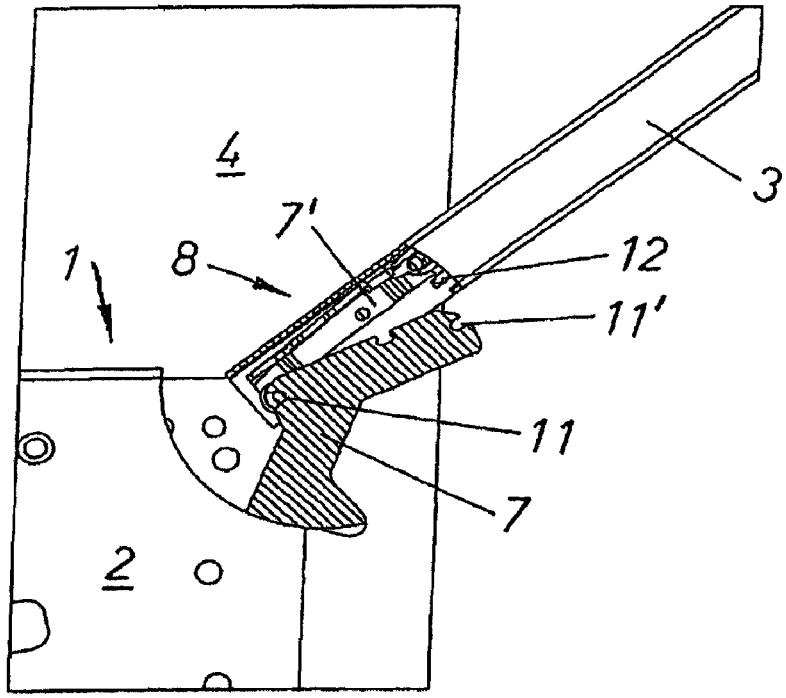
FIGS. 2*a*, 2*b* show a partial cross sectional view of FIG. 1 with a partially fixed actuating arm and an enlarged view of a detail.
Figure 2B:
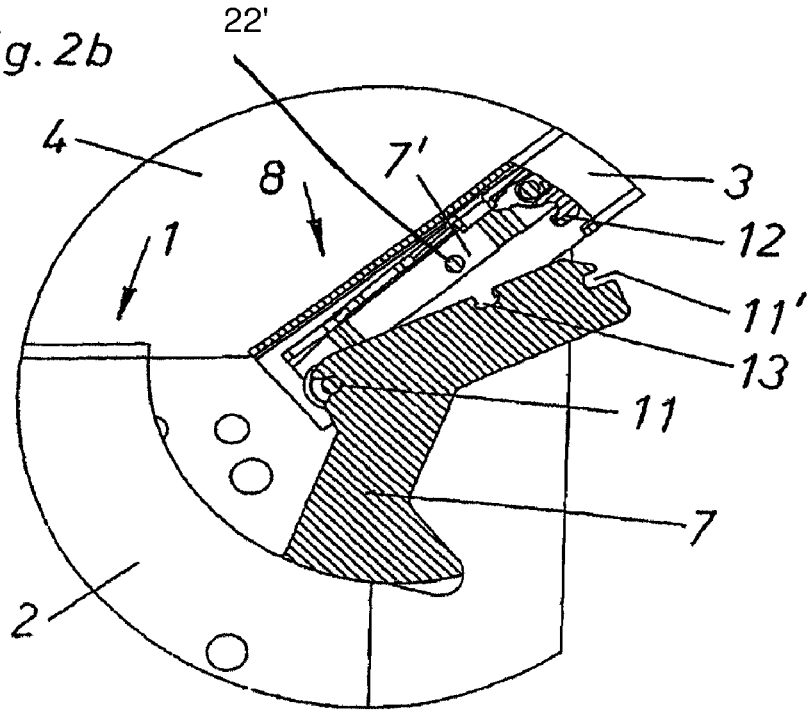

FIG. 2*a* shows a section of FIG. 1 with a partly fixed actuating arm 3, FIG. 2*b* shows an enlarged detailed view of FIG. 2*a*. The base body 2 of the actuator 1 is secured to a side wall of the furniture body 4. The locking element 7 mounted movably on the base body 2 comprises two or more channel-like grooves 11, 11', which are provided for mounting corresponding parts of the locking element 7' of the actuating arm 3. The locking element 7' is firstly inserted into the channel-like groove 11 of the locking element 7 and then pivoted so far until the retainer 12 of the locking element 7' snaps fully into the second channel-like groove 11' of the locking element 7. The locking element 7' can comprise a spring-loaded retainer 12 for example. For additional centring or stabilising of the actuating arm 3 an additional channel-like groove 13 can be provided for mounting a corresponding bolt element 22' of the locking element 7'.

Figure 3:
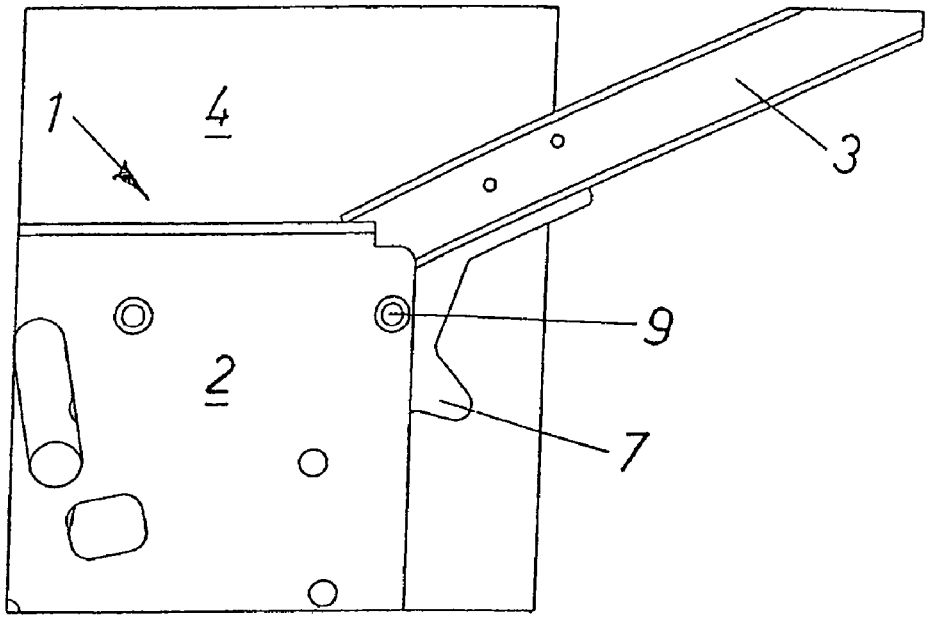
FIG. 3 shows a side view of an actuator with a secured actuating arm.

FIG. 3 shows a side view of a side wall of the furniture body 4, on which the base body 2 of the actuator 1 is mounted. In the figure shown the actuating arm 3 is locked completely to the locking element 7 of the base body 2.

Figure 4:
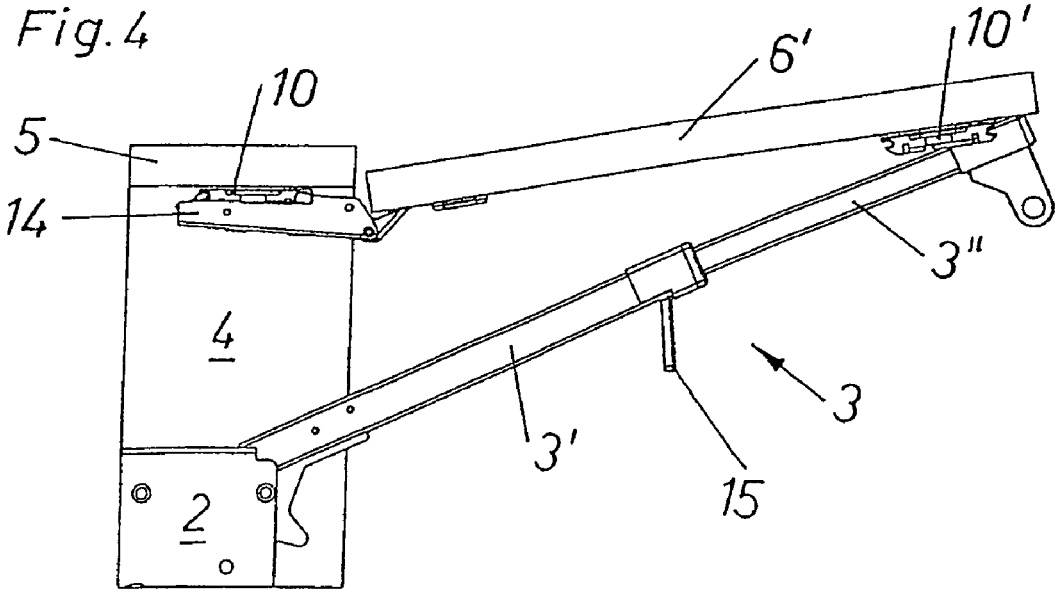
FIG. 4 shows a side view of a piece of furniture with a mounted upper part flap.

FIG. 4 shows a side view of the actuator 1, the actuating arm 3 of which consists of at least two parts 3', 3" that can be moved relative to one another or secured to one another. In this way an optimum adjustment of length to various sizes of the flap is possible. The relative position of the two parts 3, 3' can be fixed by a clamping connection 15, preferably a tilting lever. A base plate 10, onto which a hinge 14 can be clipped, is screwed onto the underside of the cabinet shelf 5—as already shown in FIG. 1. An upper part flap 6' is mounted onto the hinge 14. Furthermore, a further base plate 10' is provided on the upper part flap 6' onto which a base plate of an additional part flap 6" can be hinged.

Figure 5:
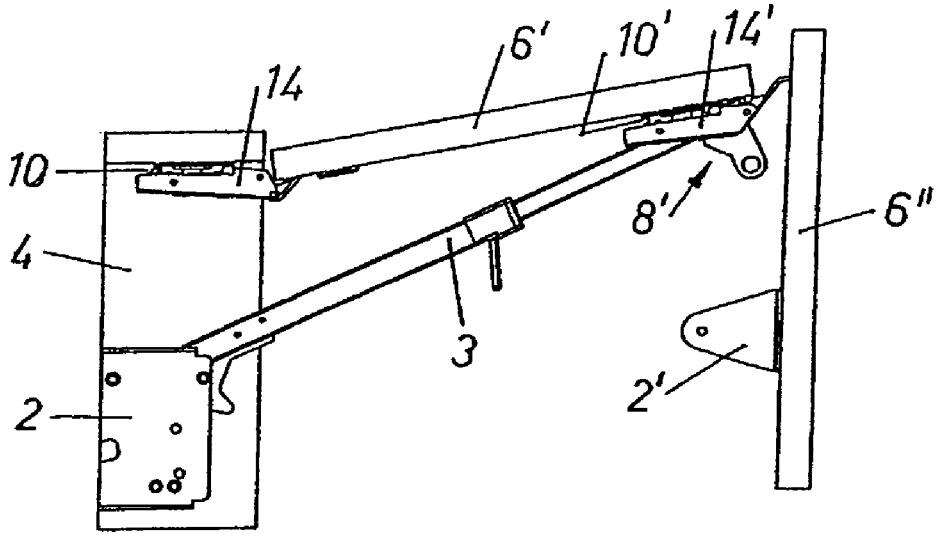
FIG. 5 shows the embodiment of FIG. 4 with a hinged lower part flap.

FIG. 5 shows the embodiment from FIG. 4 with an additionally hinged part flap 6" which is connected to the upper part flap 6' by a hinge 14' clipped onto the base plate 10'. The actuating arm 3 comprises a second fastening device 8' which is provided for detachably connecting the actuating arm 3 to a base body 2' secured to the lower part flap 6".

Figure 6A:
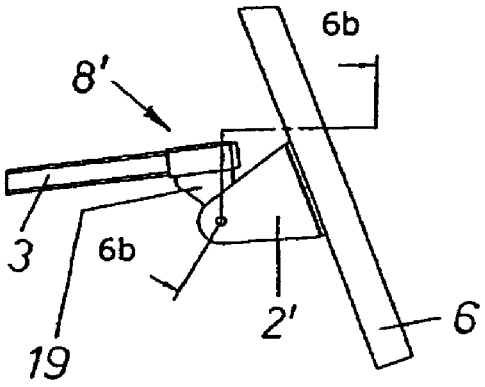
FIGS. 6*a*, 6*b* show an embodiment of a flap-side fastening device and a cross section along the axis 6*b*-6*b*.
Figure 6B:
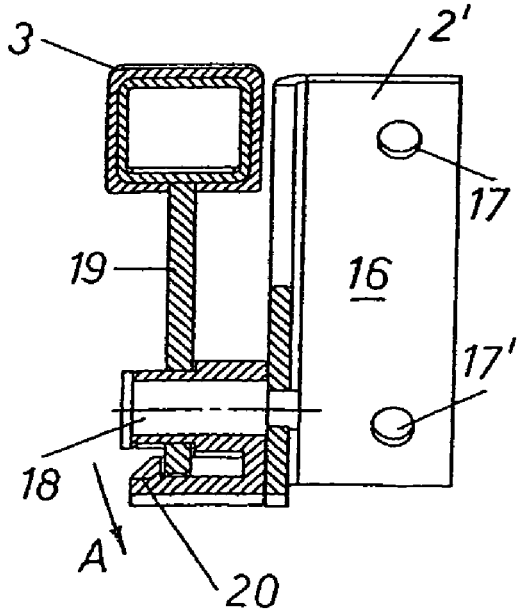

FIG. 6*a* shows the actuating arm 3 on the end section of which a fastening device 8' is arranged for detachably connecting with a base body 2' fixed to the flap 6. FIG. 6*b* shows a cross section along the axis 6*b*-6*b* of FIG. 6*a*. The base body 2' comprises a securing flange 16 which is screwed to the flap 6 through openings 17, 17'. Furthermore, the base body 2' comprises a riveted bolt 18 onto which a retaining element 19 of the actuating arm 3 is fitted. This mechanical locking connection comprises a spring-loaded retaining nose 20, which is provided for fixing the actuating arm 3, and which by pressure against its spring force in the direction of arrow A can be disengaged from the retaining element 19 of the actuating arm 3.

Figure 7A:
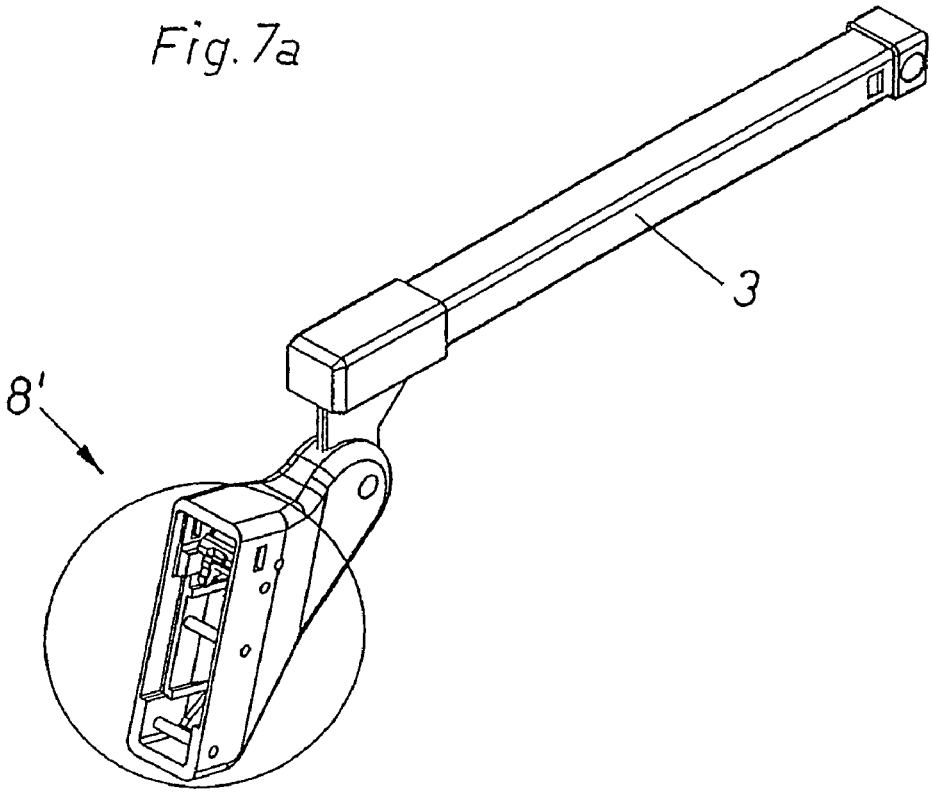
FIGS. 7*a*, 7*b* show a further embodiment of a flap-side fastening device and an enlarged view of a detail.
Figure 7B:
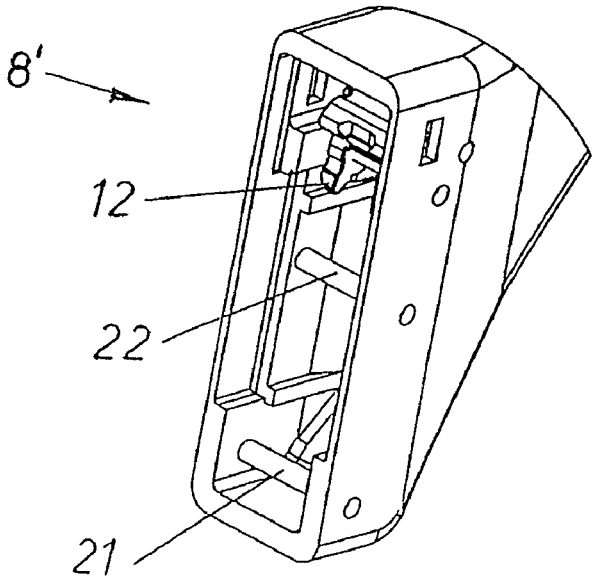

FIG. 7*a* shows the flap-side end of the actuating arm 3, FIG. 7*b* shows an enlarged view of a detail of the circle of FIG. 7*a*. According to a variant of the solution shown in FIGS. 6*a*, 6*b* a fastening device 8' is provided, which, similar to FIGS. 2*a*, 2*b*, comprises a preferably spring-loaded retainer 12. In a first assembly stage firstly the bolt 21 is inserted into a corresponding channel-like groove on the base body 2'—not shown—and then finally locked to the retainer 12 by pivoting. The bolt 22 is also used for centring or stabilising the actuating arm 3 secured to the base body 2'.

Figure 8A:
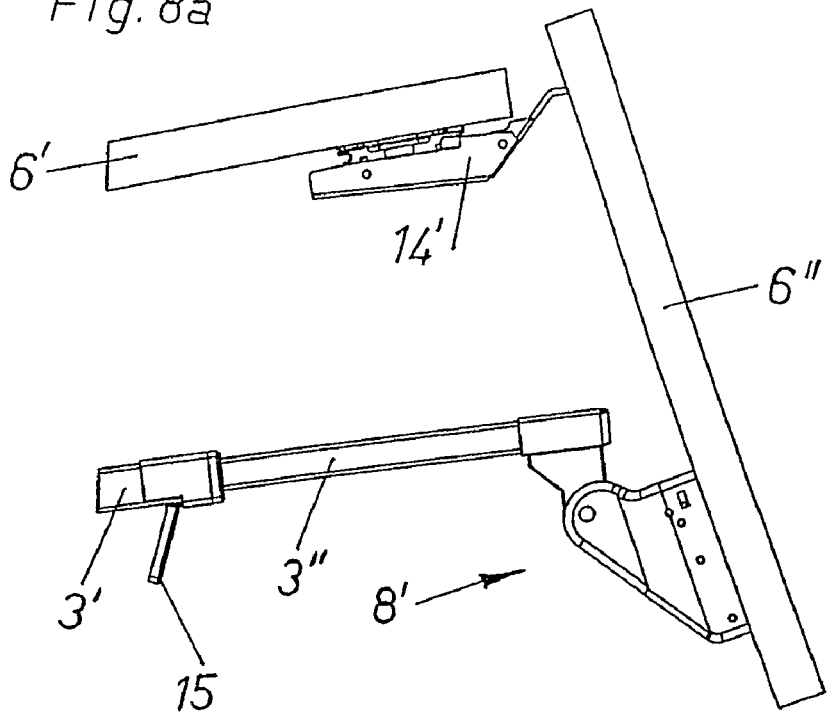
FIGS. 8*a*, 8*b* show the embodiment of FIGS. 7*a*, 7*b* and the embodiment of FIGS. 6*a*, 6*b*, FIGS. 9*a*, 9*b* show a side view of a flap-side fastening device and a vertical cross section of the fastening device.

FIG. 8*a* shows the embodiment of FIGS. 7*a*, 7*b*, wherein the flap-side fastening device 8' has already been clipped onto a base plate 10" mounted on the rear side of the lower part flap 6". The two longitudinally-adjustable parts 3', 3" of the actuating arm 3 can thus be adjusted in an optimum manner to the required length and locked by means of the clamping connection 15.

Figure 8B:
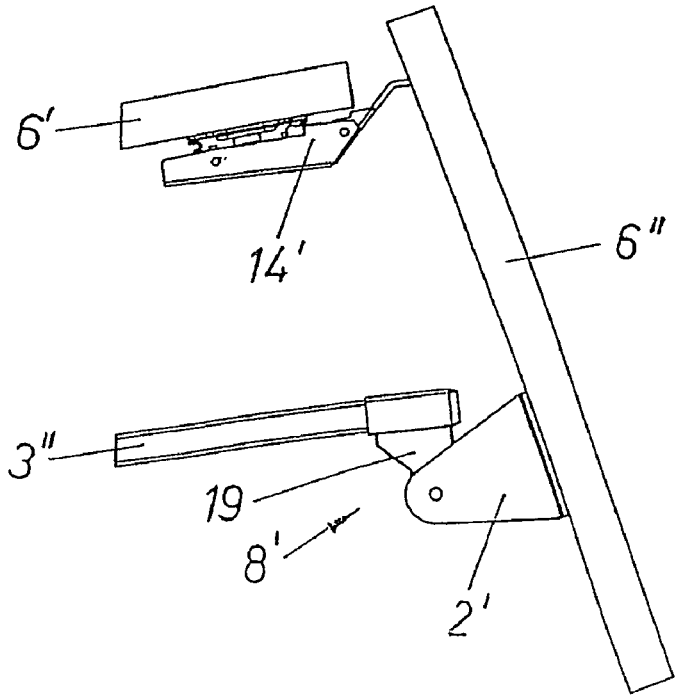

FIG. 8*b* shows the embodiment of FIGS. 6*a*, 6*b*, wherein the flap-side fastening device 8' with its retaining element 19 has been fitted onto a bolt 18—as shown in FIG. 6*b*—and held by the retaining nose 20.

Figure 9A:
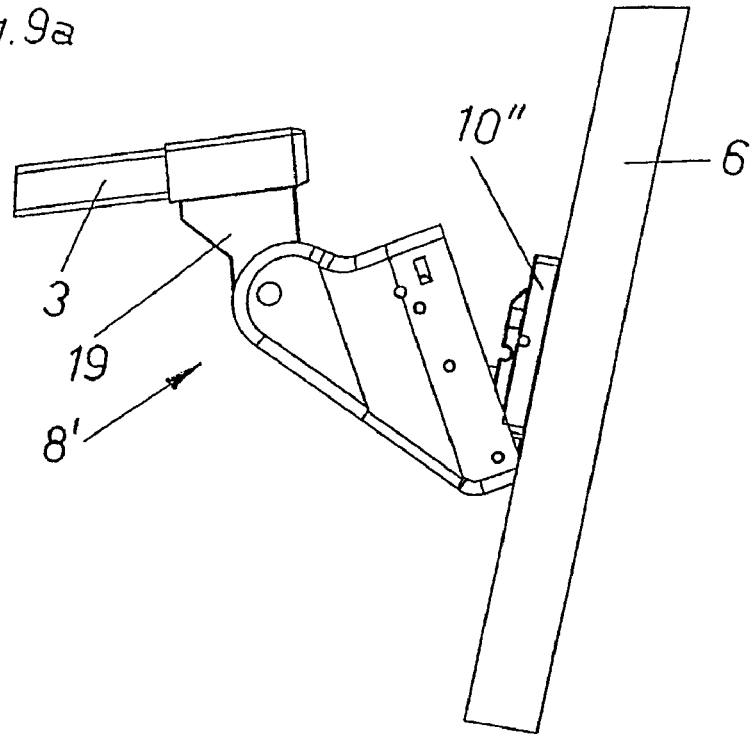
Figure 9B:
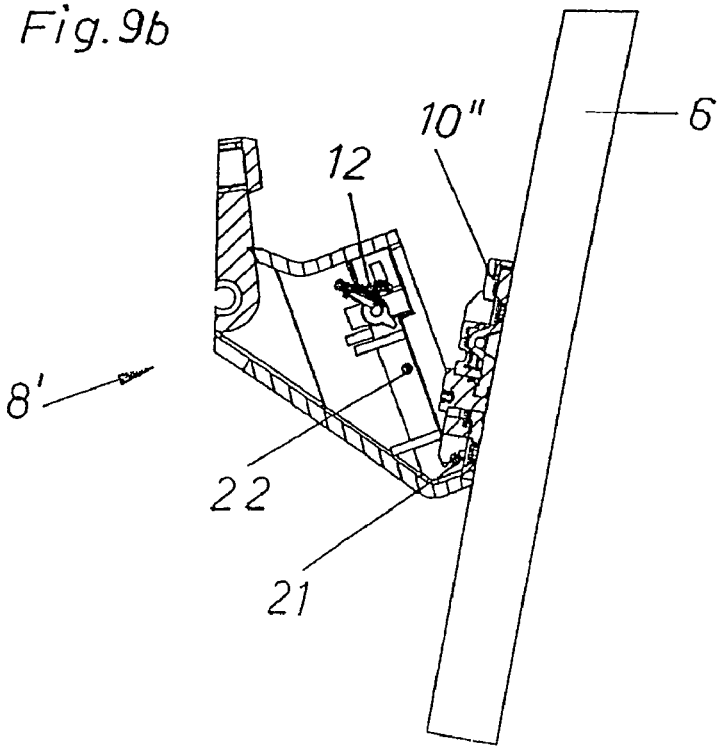

FIG. 9*a* shows a side view of the flap-side fastening device 8' for connection with a flap 6, FIG. 9*b* a vertical cross section of FIG. 9*a*. With regard to FIG. 7*b* the bolt 21 is inserted in a corresponding groove in the base plate 10", then the fastening device 8' is pivoted towards the base plate 2' and the spring-loaded retainer 12 is completely locked onto the base plate 10". For additional centring or stabilisation the middle centring bolt 22 is provided, which in the locked position is also mounted in a corresponding groove in the base plate 10".

Figure 10:
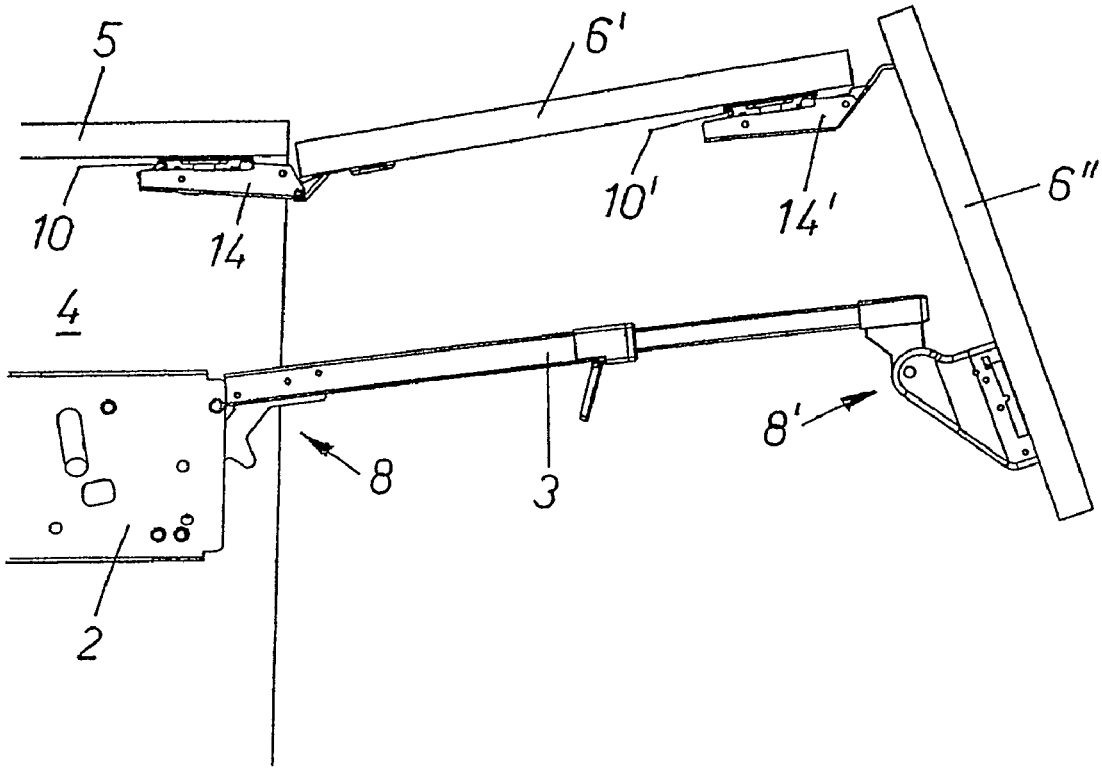
FIG. 10 shows an example of a bi-fold flap with an actuating arm having fastening devices on both sides.

FIG. 10 shows an example of a bi-fold flap 6', 6", which is hinged horizontally onto the bottom side of the cabinet shelf 5. The upper part flap 6' is secured by way of a hinge 14 clipped onto a base plate 10. The lower part flap 6" is also secured to the upper part flap 6' by way of a hinge 14' which is clipped onto a base plate 10'. The base body 2 of the actuator 1 is secured onto a side of a furniture body 4. At both ends the actuating arm 3 comprises fastening devices 8, 8' which are provided for the detachable connection of the actuating arm 3 to the base body 2 and the not-shown base plate 10' on the rear side of the lower part flap 6". It is particularly advantageous if all of the parts to be secured, i.e. the actuating arm 3 and hinge 14, 14' have the same fastening mechanism. In this way there can be a high degree of variability and replacement is straightforward whilst minimising the structural cost.

Figure 11:
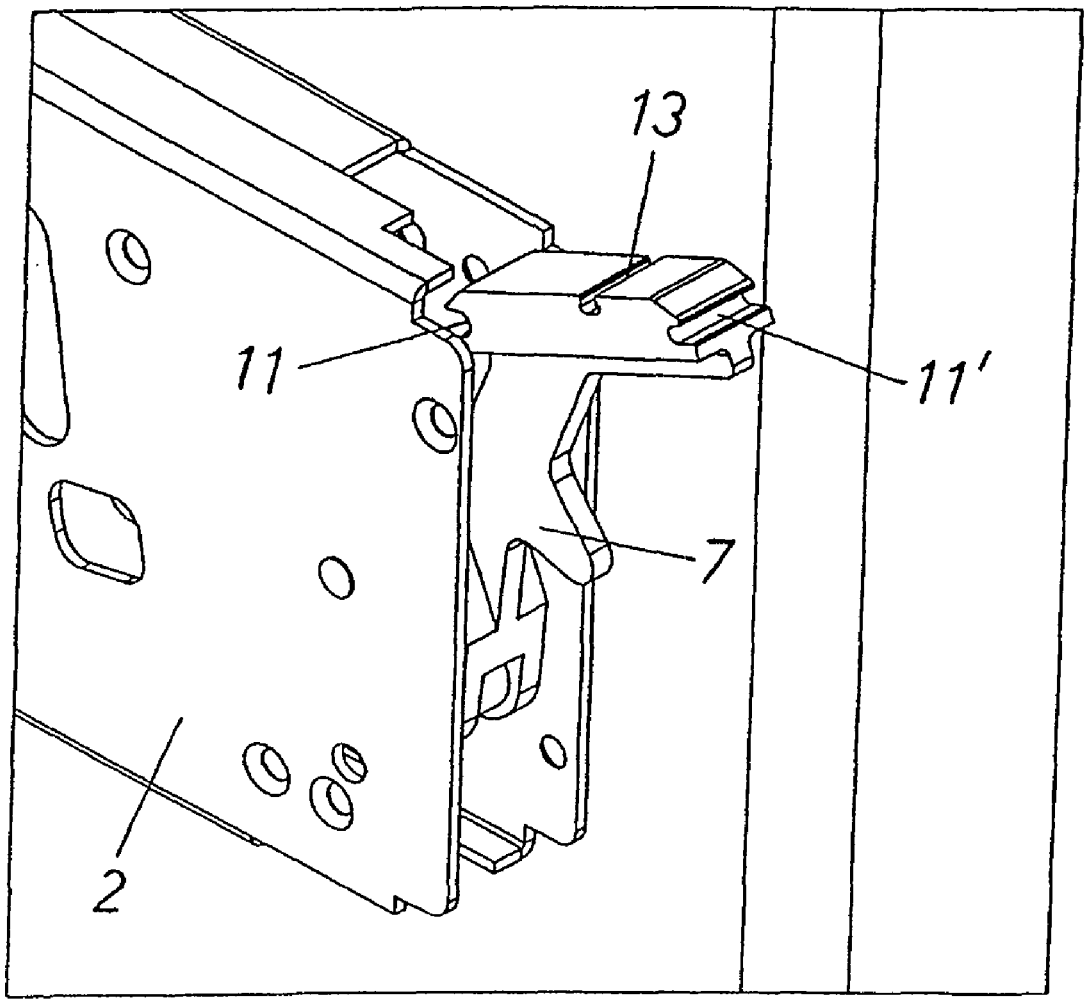
FIG. 11 shows a perspective partial view of a base body which can be secured to a furniture body.

FIG. 11 shows a perspective view of the base body 2 which can be secured to the side wall of a furniture body 4. It comprises a pivotably-hinged locking element 7, wherein two channel-shaped grooves 11 and 11' are provided for mounting corresponding parts of the fastening device 8 of the actuating arm 3. The centring groove 13 is used for mounting the bolt 22 of the fastening device 8.

Figures 12A, 12B, 12C:
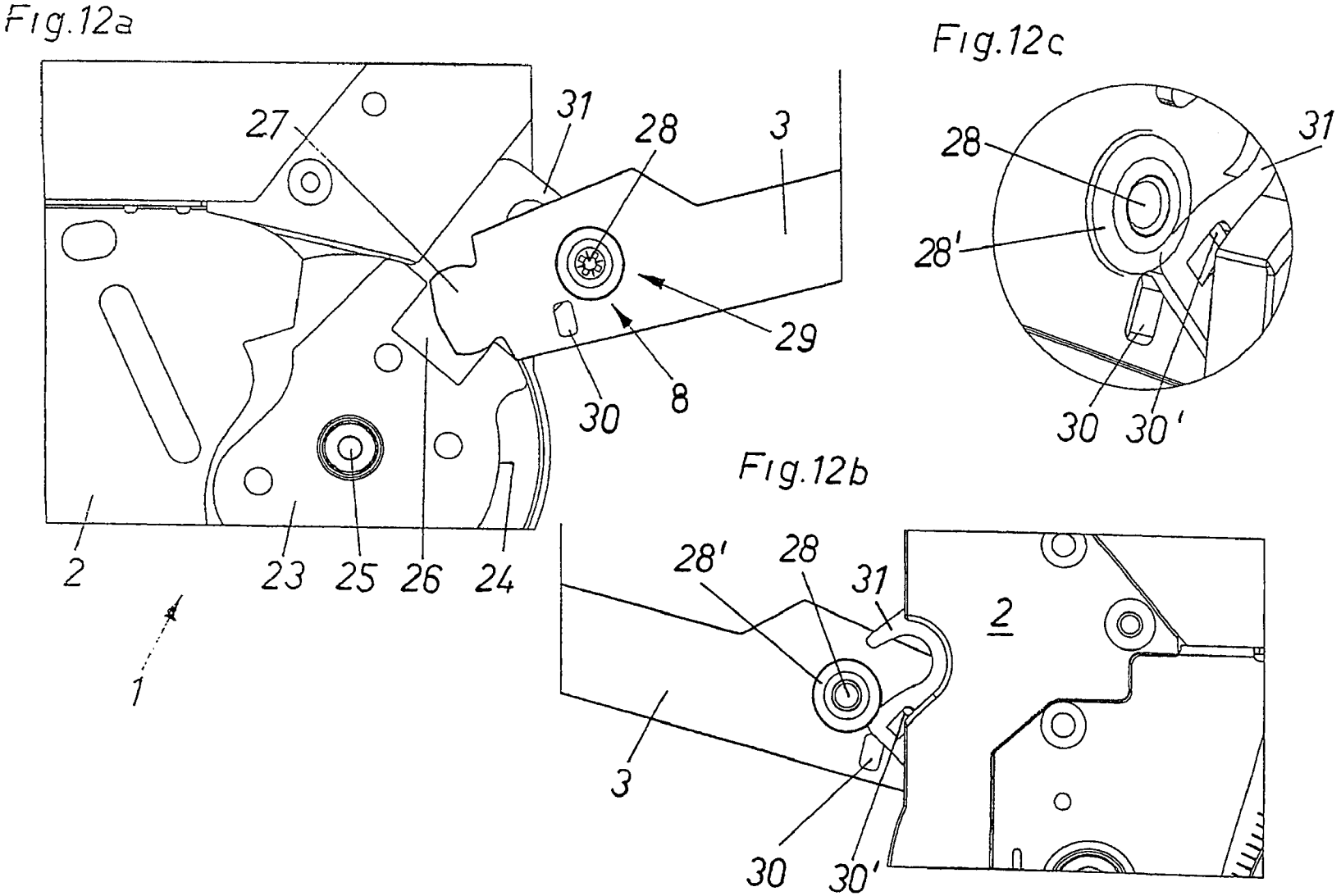
FIGS. 12*a*-12*c* show a further embodiment of the invention in various views, wherein the fastening device is in the form of a screw connection.

FIGS. 12*a*-12*c* show a further embodiment of the invention in various views. FIG. 12*a* shows—as already known—an actuator 1 with a control cam 23 hinged onto the base body 2 pivotably on the point of rotation 25 and the associated actuating contour 24. In the embodiment shown the fastening device 8 comprises a screw connection 29. Said screw connection 29 comprises a screw 28 which is preferably pre-mounted on the actuating arm 3. On mounting the actuating arm 3 onto the base body 2 firstly the retaining nose 27 formed or arranged on the actuating arm 3 is inserted into a corresponding recess 26 of the control cam 23 by pivoting the actuating arm 3 upwardly.

The recess 26 is designed so that the retaining nose 27 is mounted in an essentially play-free manner. At the end of the pivoting upwards procedure the pre-mounted screw 28, which is in engagement with a thread nut 28' located on the rear side of the actuating arm, locks together with a hook-shaped element 31 attached to the base body 2. This is made possible by the interaction of a retainer 30' in an opening 30. Then the screw 28 is tightened by a screwdriver so that the hook-shaped element 31 is clamped between the actuating arm 3 and the rear thread nut 28'. The additional locking connection 30, 30' prevents the actuating arm 3 from falling out, in case the screw 28 should become loose.

FIG. 12*b* shows a partial section of the rear side of FIG. 12*a*. This shows the retainer 30' which is mounted in assembly position in the opening 30. The screw 28 which is in engagement with the thread nut 28' is inserted into the hook-shaped element 31 by pivoting the actuating arm 3 upwardly. Then by tightening the screw 28 the hook-shaped element 31 is clamped between the actuating arm 3 and thread nut 28'.

FIG. 12*c* shows a detailed view of FIG. 12*b* in perspective view.

Figure 13B:
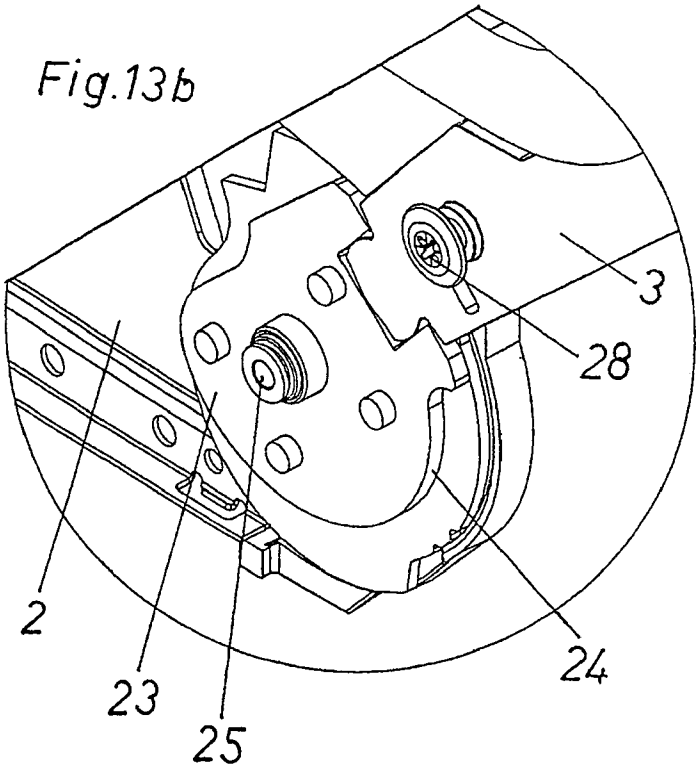
FIGS. 13*a*, 13*b* show the embodiment of FIGS. 12*a*-12*c* with a screwed on actuating arm.
Figure 13A:
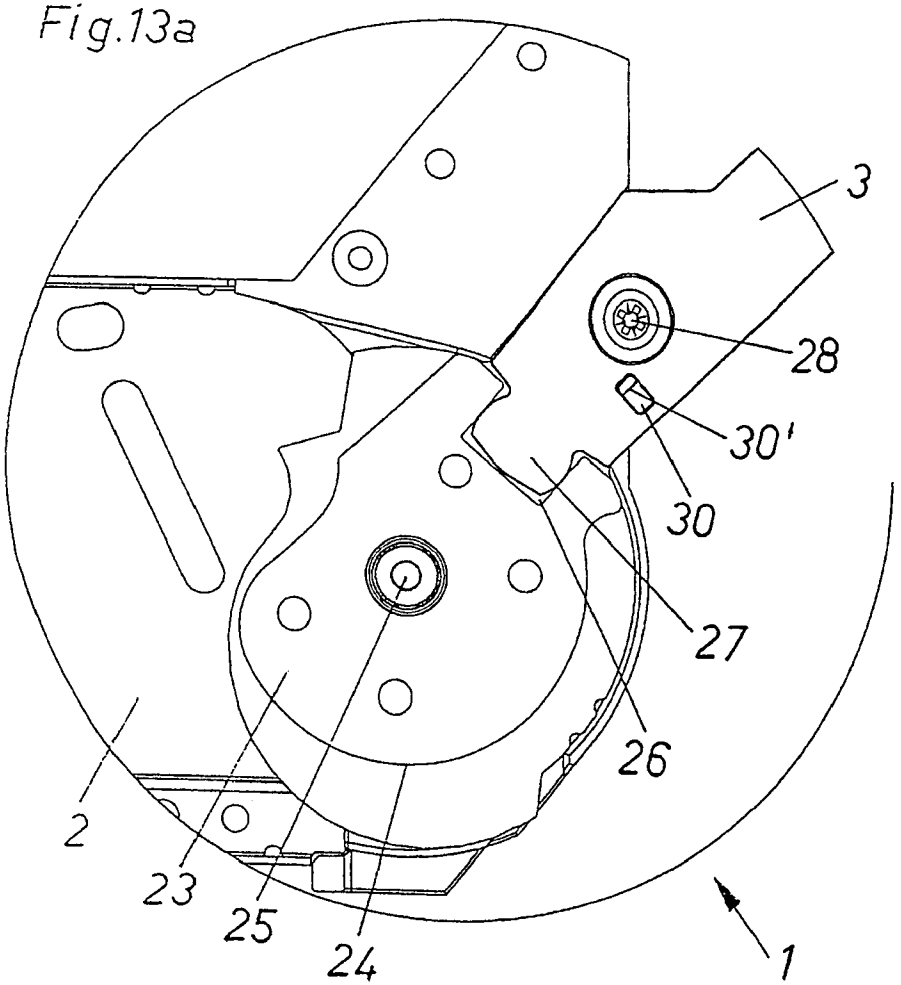

FIG. 13*a* and FIG. 13*b* show the actuating arm 3 which is completely mounted on the base body 2 or on its control cam 23. FIG. 13*a* shows a side view, in which the retaining nose 27 of the actuating arm 3 is mounted by pivoting upwards in a play-free manner in the recess 26 of the control cam 23. In the figure shown the retainer 30' is located in the opening 30, whereby for safety reasons in addition to the already described screw connection the actuating arm 3 is locked onto the base body 2.

FIG. 13*b* shows the actuator 1 in perspective view. By tightening the screw 28 the actuating arm 3 can be secured onto the base body 2 in a friction-locked manner.

The present invention is not restricted to the embodiments shown but encompasses or extends to all variants and technical equivalents which fall within the scope of the following claims. Also the details on position chosen in the description, such as e.g. top, bottom, side etc. relate to the normal installation position of the actuator 1 or to the Figure being described or represented at the time, and if there is a change in position they should be transposed to the new position accordingly.

The invention claimed is:

1. An actuator for moving a flap of a piece of furniture, comprising:

a first base body to be mounted on a furniture body of the piece of furniture, a second base body to be mounted on the flap, a spring loaded actuating arm for moving the flap, said actuating arm comprising a first mechanical locking connection detachably connecting said actuating arm to said first base body and a second mechanical locking connection detachably connecting said actuating arm to said second base body, wherein said first mechanical locking connection is at least partially disposed in an interior of said actuating arm and comprises an inserting portion and a retainer, wherein said first base body includes a locking element, said locking element being pivotably mounted to said first base body and pivotable about a center of rotation disposed on said first base body, wherein said locking element comprises a first channel receiving said inserting portion and a second channel receiving said retainer, wherein said first mechanical locking connection is detachably locked onto said locking element by inserting said inserting portion into said first channel and pivoting said actuating arm about said inserting portion and said first channel until said retainer engages said second channel, and wherein said first mechanical locking connection is detachably locked onto said locking element such that said actuating arm is immovable relative to said locking element and rotatable about said center of rotation and such that the actuating arm is pivotably mounted to said first base body.

2. The actuator according to claim 1, wherein said retainer is spring loaded.

3. The actuator of claim 2, wherein said retainer is entirely disposed in said interior of said actuating arm.

4. The actuator according to claim 1, wherein said second mechanical locking connection comprises a retaining nose detachably securing said actuating arm to said second base body, said actuating arm being detachable from said second base body by applying a force against a spring force of said retaining nose.

5. The actuator according to claim 1, wherein said actuating arm comprises a first arm portion and a second arm portion, said first arm portion being movable relative to said second arm portion.

6. The actuator according to claim 5, further comprising a clamping connection for securing said first arm portion against movement of said first arm portion relative to said second arm portion.

7. The actuator according to claim 5, wherein said first arm portion is urged in a direction away from said second arm portion by a spring.

8. The actuator according to claim 1, wherein said actuating arm locking element is pivotable about a horizontal axis.

9. The actuator according to claim 1, wherein said first mechanical locking connection is entirely disposed in said interior of said actuating arm.

10. The actuator according to claim 1, wherein said first mechanical locking connection further comprises a bolt element disposed between said inserting portion and said retainer and said locking element comprises a third channel for receiving said bolt element, and wherein said first mechanical locking connection is detachably locked onto said locking element by inserting said inserting portion into said first channel and pivoting said actuating arm about said inserting portion and said first channel until said bolt element engages said third channel and said retainer engages said second channel.

11. The actuator according of claim 1, wherein said spring loaded actuating arm is urged to expand in a longitudinal direction thereof by a spring.

12. The actuator of claim 1, wherein said retainer is entirely disposed in said interior of said actuating arm.

* * * * *